US009179769B1

(12) United States Patent
Port

(10) Patent No.: US 9,179,769 B1
(45) Date of Patent: Nov. 10, 2015

(54) SEAT DESKTOP CONVERSION DEVICE

(71) Applicant: Larry Port, Brooklyn, NY (US)

(72) Inventor: Larry Port, Brooklyn, NY (US)

( * ) Notice: Subject to any disclaimer, the term of this patent is extended or adjusted under 35 U.S.C. 154(b) by 0 days.

(21) Appl. No.: 14/459,647

(22) Filed: Aug. 14, 2014

Related U.S. Application Data

(60) Provisional application No. 61/868,288, filed on Aug. 21, 2013.

(51) Int. Cl.

| | |
|---|---|
| ***A47B 5/00*** | (2006.01) |
| ***A47B 83/02*** | (2006.01) |
| ***A47C 1/12*** | (2006.01) |
| ***A47B 5/04*** | (2006.01) |

(52) U.S. Cl.
CPC . *A47B 83/02* (2013.01); *A47B 5/04* (2013.01); *A47C 1/12* (2013.01)

(58) Field of Classification Search
CPC ..... A47B 83/02; A47B 31/06; A47B 5/00; B60N 3/004; B60N 3/102; A47C 7/68; A47C 7/70
USPC ..... 297/173, 263; 108/42, 44, 134, 135, 108/160, 152
See application file for complete search history.

(56) References Cited

U.S. PATENT DOCUMENTS

| | | | | |
|---|---|---|---|---|
| 955,184 | A | | 4/1910 | Milner |
| 1,525,928 | A | | 2/1925 | Fitch |
| 1,903,900 | A | | 4/1933 | Martin |
| 2,278,014 | A | | 3/1942 | Olivant |
| 2,469,657 | A | * | 5/1949 | Linda et al. ..... 108/38 |
| 2,483,043 | A | * | 9/1949 | Golden ..... 297/163 |
| 2,585,742 | A | | 2/1952 | Condon |
| 2,601,177 | A | | 6/1952 | Smullen |
| 2,637,367 | A | * | 5/1953 | Barecki ..... 297/146 |
| 2,720,436 | A | | 10/1955 | Covey |
| 2,774,640 | A | | 12/1956 | Harmon et al. |
| 2,787,508 | A | | 4/1957 | Math |
| 2,881,039 | A | | 4/1959 | Guzman |
| 2,921,824 | A | | 1/1960 | Richter |
| 2,932,544 | A | | 4/1960 | Lambert |
| 2,963,078 | A | * | 12/1960 | Ferrelle ..... 297/146 |
| 2,973,028 | A | | 2/1961 | Celeste |
| 3,049,374 | A | | 8/1962 | Nance |
| 3,393,008 | A | | 7/1968 | Bendell |
| 3,631,820 | A | * | 1/1972 | Taber ..... 108/2 |
| 3,838,841 | A | * | 10/1974 | Cadman ..... 248/240.4 |
| 3,910,632 | A | | 10/1975 | Marechal |
| 4,369,715 | A | * | 1/1983 | Ingersoll et al. ..... 108/2 |
| 4,511,178 | A | | 4/1985 | Brennan |
| 4,668,010 | A | * | 5/1987 | Fujiwara ..... 297/150 |
| 5,169,209 | A | | 12/1992 | Beroth |

(Continued)

*Primary Examiner* — Janet M Wilkens
(74) *Attorney, Agent, or Firm* — Davidoff Hutcher & Citron LLP; David H. Siegel

(57) ABSTRACT

A desk includes a seat mounting member configured to attached to a vertical surface such as the back portion of a seat in an auditorium, a horizontal support member defining an at least partly planar upper surface for use as a desktop, and a horizontal support mounting unit that has a first position connecting the horizontal support member to the seat mounting member in which the upper surface of the horizontal support member is substantially in an in-use position, and a second position connecting the horizontal support member to the seat mounting member in which the upper surface of the horizontal support member is substantially in a stowed position. The horizontal support can be moved between its first, use and second, stowed positions by manipulating the horizontal support mounting unit.

26 Claims, 8 Drawing Sheets

(56) References Cited

U.S. PATENT DOCUMENTS

| | | | | |
|---|---|---|---|---|
| 5,370,060 | A | 12/1994 | Wang | |
| 6,135,548 | A | 10/2000 | McGuire | |
| 6,170,909 | B1 | 1/2001 | Inoue | |
| 6,607,241 | B2 * | 8/2003 | Johnston | 297/188.06 |
| 6,830,292 | B1 | 12/2004 | Yoda | |
| 7,341,005 | B2 | 3/2008 | Baggott | |
| 7,635,160 | B2 | 12/2009 | Figueras Mitjans | |
| 7,651,160 | B2 * | 1/2010 | Okumura et al. | 297/163 |
| 8,434,415 | B1 * | 5/2013 | Federici et al. | 108/42 |
| 2002/0073632 | A1 * | 6/2002 | Huffman | 52/29 |
| 2009/0284030 | A1 * | 11/2009 | Rein | 293/142 |
| 2011/0248531 | A1 | 10/2011 | Powell | |
| 2012/0313404 | A1 | 12/2012 | Ackeret et al. | |

* cited by examiner

SEAT DESKTOP CONVERSION DEVICE

PRIOR APPLICATIONS

This application claims the benefit of U.S. Provisional Application No. 61/868,288, filed Aug. 21, 2013.

FIELD OF THE INVENTION

The present invention relates generally to a desk formed from a horizontal support surface that can be attached to a vertical support structure, which may be part of a seat. More specifically, the present invention relates to an attachment to the back of a vertical support of a first seat in an auditorium to enable a second auditorium seat behind the first seat to form a desk by mounting a horizontal support surface to the attachment.

BACKGROUND OF THE INVENTION

There are several situations where it is desirable to have a support surface temporarily formed in front of a seat or chair to allow for placement of objects thereon, that also is collapsible or may be otherwise moved out of its in-use position to a stowed position, e.g., to allow for passage of people in front of the seat or chair.

For example, it is known in the art that armchairs are equipped with lecterns or small boards incorporated at the side or on the armrest so that the lectern or board may be swiveled to an in-use position or folded in a stowed position. In this regard, U.S. Pat. No. 7,635,160 describes an armchair and table for conference halls that includes a backrest that can be lowered over a seat in combination with movement of a table board that can swivel between a stowed position and an in-use position. The board is on a column, with a variable height, that is fastened to the armchair by a ball joint anchor. The column allows the board to be positioned at a height useful for a desk.

As another example, various food and beverage holders have been developed to attach to the back of a chair of the type often found in a sports stadium, and provide surface area to support one or more items such as food or beverage. In this regard, U.S. Pat. No. 7,341,005 describes a tray for supporting items such as food or beverage in a substantially horizontal position relative to a stadium seat. A retaining flange is coupled to the tray and integrated with an existing stadium seat such that the tray may retain items in a fixed relationship with a stadium seat situated rearward of the stadium seat to which the tray is attached.

As another example, various tables for a motor vehicle seat are known, typically including a plate-shaped table attached to the back of a motor vehicle seat by attaching means or supporting means. U.S. Pat. No. 6,830,292 describes a table supporting device having a loop at an upper end. The loop is the supporting device which is removably hung on the headrest of the motor vehicle seat so that the supporting device is positioned substantially vertically. A plate-shaped table has a table holding mechanism that holds the table vertically rotatable by means of a horizontal shaft. The table holding mechanism has a vertical hole having a larger diameter than the table supporting device. The table supporting device passes through the vertical hole of the table holding mechanism. A vertical bolt threadedly engages with the table holding mechanism to maintain the table at a desired angle.

U.S. Pat. No. 6,170,909 discloses a table assembly swingably supported from the rear of a supporting member. A hook enables hanging of objects from the table and is situated so as to hang below a hole in the table when the table is in an in-use position, and to be automatically stored within said hole when the table is in a stowed position.

Yet another example of a table assembly for a vehicle is described in U.S. Pat. No. 5,370,060. This table assembly includes a table pivotably connected to a frame, two bars retractably fastened to the frame, and lock screws threaded into screw holes on the frame for locking the retractable bars at a desired elevation. Each retractable bar has a top end that terminates in a swivel hook for mounting on the head rest of a car seat. The table has recessed top compartments covered by a sliding cover for storage, and collapsible stands at the bottom for supporting the foldaway table on the ground if it is removed from the car seat.

Still another example of a table assembly for a vehicle is described in U.S. Pat. No. 5,169,209. The table assembly is attached to a vehicle passenger seat including a seat bottom, seat back and seat frame. The table assembly includes a tray table, a pair of legs on which the tray table is mounted. The legs include first and second extensions projecting outwardly from the end of the pair of legs remote from the tray table and define respective stud-receiving recesses between the first and second extensions. A seat back pivot mounts the seat back on the seat frame for movement between a seating position with the seat back substantially upright and substantially perpendicular to the seat bottom and a break back position with the seat back forward and substantially parallel to the seat bottom. A tray table pivot is carried on the seat frame and includes first and second pivot studs positioned on respective sides of the seat frame for being received in the stud receiving recesses of the tray table legs.

Another example of a table assembly for a vehicle is described in U.S. Pat. No. 4,511,178. The assembly permits the table to be quickly removed and replaced by persons without the use of tools. Small studs on each side of the seat pivotally support apertures in the lower ends of the tray table legs. The legs may be deflected toward each other to release their mounting engagement with the studs.

SUMMARY OF THE INVENTION

The present invention is directed to a desk attached to the back of a chair such as an auditorium chair, contemplated for use by students in classrooms, meeting halls and auditoria. More particularly, there are three novel aspects to the instant invention, although not necessarily all three aspects are incorporated into every embodiment of the invention. The first novel aspect is the desk is configured to be permanently or semi-permanently retrofitted to a seat wherein a mounting portion for the desk may be affixed to a generally vertical surface such as the back portion of an existing seat.

The second novel aspect is when the desk is in its in-use position and force, such as pressure or weight, is exerted downward on the desk, the horizontal support member will break away from the mounting member when a certain tolerance is exceeded. This allows users of the desk to avoid injuries or greater damage to the seat or other property that may occur if the horizontal support member did not break away, allowing the pressure or weight to cause the seat or other structure to fail in an unexpected manner.

Third, when not in use, the horizontal support member may be attached to a seat mounting member by webbing material to allow the desk to hang from the webbing material. This avoids the need for a user, such as a student, to disengage the desk from a first rigid in-use position and then re-engage it to a second rigid stowed position. Instead, the user can simply disengage the desk from its rigid in-use position and allow the desk to hang without having to reposition or further manipulate the desk into a second rigid position. As is well known, students typically leave classrooms as quickly as possible after class and do not wish to be bothered with additional chores, such as mounting the horizontal support member in a rigid stowed position. The embodiment of the invention including this webbing allows for a neat and safe stowed position for the desk. The webbing also prevents theft or misuse of the desk by users or other persons.

One embodiment of a desk for use by students in accordance with the invention includes a seat mounting member configured to attach to a vertical or substantially vertical surface such as the back portion of a seat in an auditorium, a horizontal support member for use as a desktop, and a horizontal support mounting unit. The horizontal support mounting unit has a first position connecting the horizontal support member to the seat mounting member in which the upper surface of the horizontal support member is substantially horizontal, and a second position connecting the horizontal support member to the seat mounting member in which the upper surface of the horizontal support member is substantially vertical. Said first position is an in-use position and said second position is a stowed position. The horizontal support can be moved between in-use and stowed positions by manipulating the horizontal support mounting unit. In the second position, the horizontal support member may be connected to the seat mounting member by a flexible connector, a rigid connector or a rigid mounting.

In a second embodiment, the seat mounting member includes a body defining first and second engagement portions. The horizontal support mounting unit engages with the first engagement portion of the seat mounting member when in an in-use position and engages with the second engagement portion of the seat mounting member when in its stowed position. The horizontal support mounting unit may be separable from the seat mounting member to enable movement between its first and second positions.

The first engagement portion includes a slot defined laterally by a rear wall of the body of the seat mounting member and vertically by upper and lower rearward projections from the rear wall. The lower projection includes a support lip at its upper edge that supports the horizontal support mounting unit when in the in-use position. The upper projection includes one or more flanges that retain the horizontal support mounting unit when in the in-use position. The lower edge(s) of the flange(s) has/have a complementary construction to the upper region of the horizontal support mounting unit to enable the horizontal support mounting unit to hold the upper region of the horizontal support mounting unit in the slot when in the in-use position.

The second engagement portion includes a slot opening to a bottom and defined in part by two inward projections. The slot is configured to receive part of the horizontal support mounting unit. Specifically, the horizontal support mounting unit includes a base and a U-shaped portion extending from the base, with part of the horizontal support being situated in the aperture of the U-shaped portion and secured thereto. Said base includes two projections configured to be received in the slot and support the horizontal support mounting unit in the stowed position.

In another embodiment, the horizontal support mounting unit includes a base connected to the horizontal support and a flexible connector that connects the base of the seat mounting member to the body. The flexible connector may be comprised of flexible webbing material commonly used for seat belts. This flexible arrangement allows a user, such as a student, to move the desk from its in-use position to a stowable position that only requires disengaging the desk from the in-use position without having to rigidly mount the desk in a stowable position.

In yet another embodiment, the horizontal support mounting unit includes a horizontal support mounting member having a base and a U-shaped portion extending from the base. Part of the horizontal support is situated in the aperture of the U-shaped portion and secured thereto. A flexible connector connects the base to the seat mounting member. Structure is also provided to connect the flexible connector to the seat mounting member and to connect the flexible connector to the horizontal support mounting member and the horizontal support. The flexible connector may include webbing to allow the horizontal support to hang from the seat mounting member to provide the horizontal support with its stowed position. The flexible connector enables the horizontal support mounting unit to maintain a connection between the seat mounting member and the horizontal support during between the in-use and stowed positions.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 2:
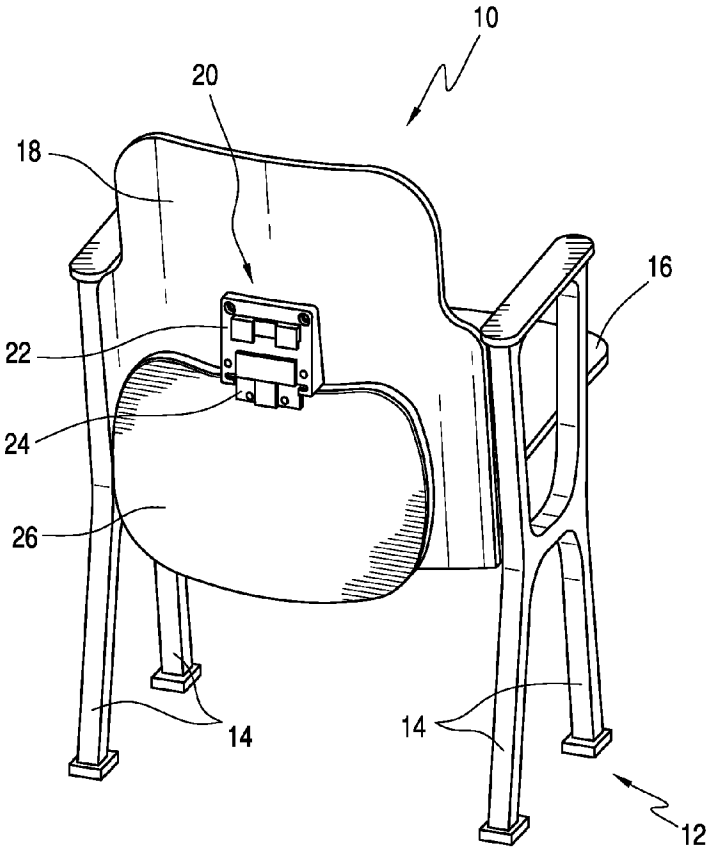
FIG. 2 is a rear, right perspective view of a seat showing the first embodiment of the desk in accordance with the invention attached thereto with its horizontal support member in a stowed position.
Figure 1:
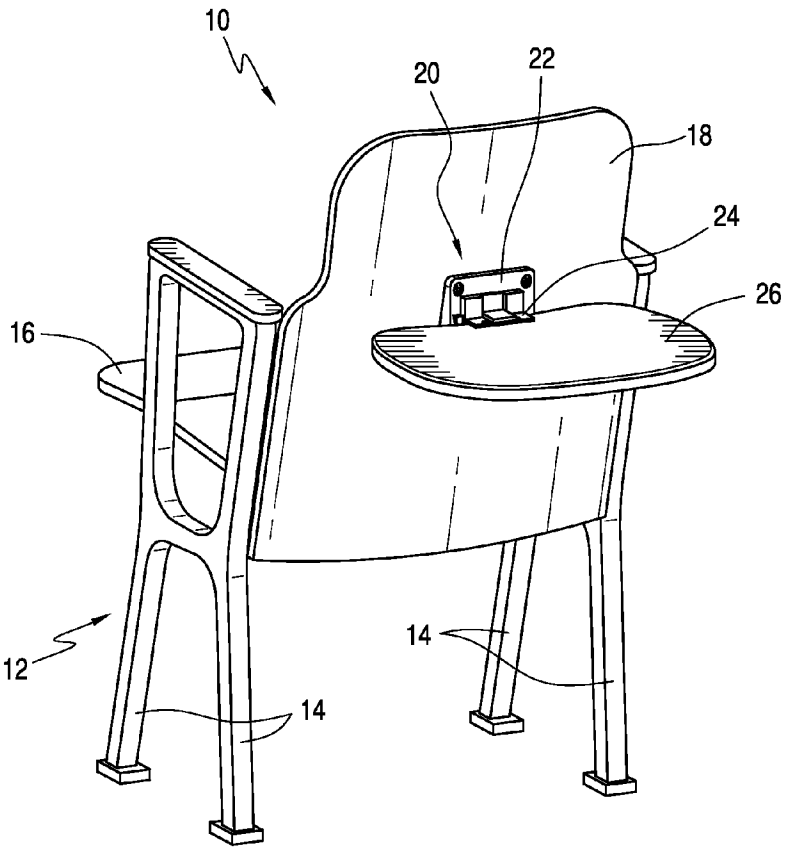
FIG. 1 is a rear, left perspective view of a seat showing a first embodiment of a desk in accordance with the invention attached thereto and with its horizontal support member in a use position.

Referring to the accompanying drawings wherein the same reference numbers refer to the same or similar elements, FIGS. 1 and 2 show a seat 10 that is typically the seat used in an auditorium. The invention is described with reference to such an auditorium seat, but is in no way limited to use with such a seat. The invention could alternatively be used in conjunction with a different type of seat, with a seat in a different environment, or with a vertical surface that is not formed by a seat, all with a view toward selectively forming a desk behind the seat or vertical surface.

Seat 10 includes a support structure 12, e.g., a plurality of legs 14 attached to the base of an auditorium, a bottom portion 16 on which the seat occupant sits and a back portion 18 against which the occupant leans their back. The invention is not limited in any manner to a seat having the structure of seat 10 shown in FIGS. 1 and 2, and may be used with any seat that has at least a back portion 18 or any other vertical surface.

Figure 15:
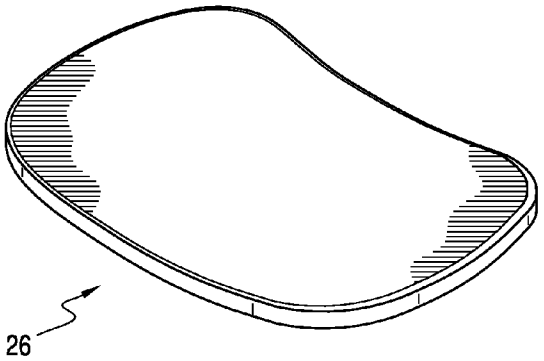
FIG. 15 is a perspective view of a horizontal support member of the desk in accordance with the invention shown in FIGS. 3 and 4.

The desk in accordance with the invention is designated generally as 20 and includes three main components: a seat mounting member 22 (shown separately in FIGS. 5-9), a horizontal support mounting member 24 (shown separately in FIGS. 10-14 and 16) and a horizontal support 26 (shown separately in FIG. 15).

Figure 4:
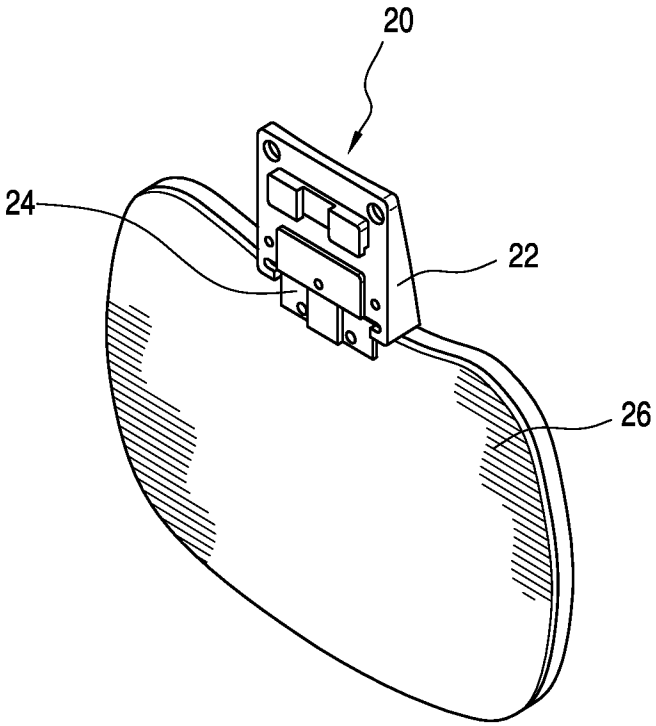
FIG. 4 is a rear, right perspective view of the desk in accordance with the invention with its horizontal support member in a stowed position.
Figure 3:
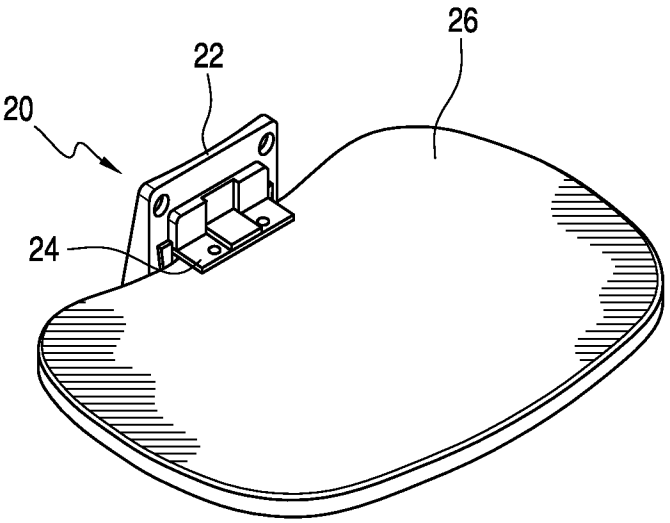
FIG. 3 is a rear, left perspective view of the desk in accordance with the invention with its horizontal support member in a use position.
Figure 5:
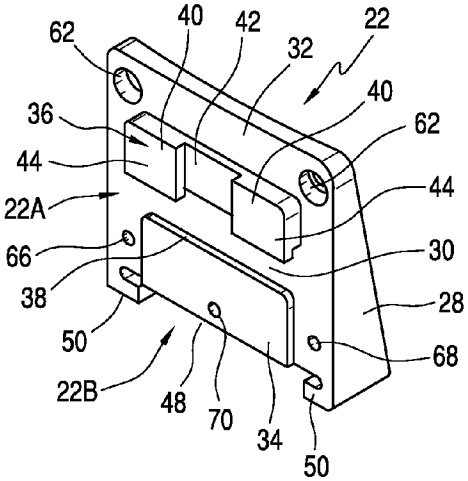
FIG. 5 is a rear, right perspective view of a seat mounting member of the desk in accordance with the invention shown in FIGS. 3 and 4.
Figure 6:
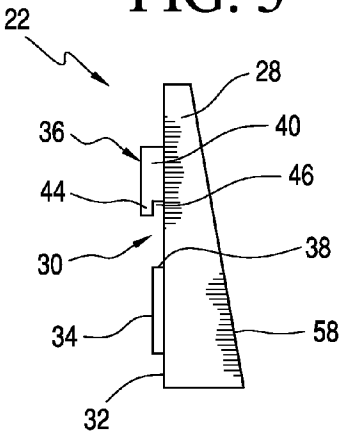
FIG. 6 is a right side view of the seat mounting member shown in FIG. 5.

Seat mounting member 22 is fixed to the back portion 18 of the seat 10 as shown FIGS. 1 and 2. Horizontal support mounting member 24 is fixed to the horizontal support 26 as shown in FIGS. 3 and 4. The horizontal support mounting member 24 may be attached to the seat mounting member 22 in two positions. In a first position, referred to as the in-use position, the horizontal support 26 is substantially horizontal as shown in FIGS. 1 and 3 and in a second position, referred to as a stowed position, the horizontal support 26 is substantially vertical as shown in FIGS. 2 and 4.

Changing between the in-use position and stowed position of the horizontal support mounting member 24 relative to the seat mounting member 22 is designed to be relatively easy to allow for convenient switching between the two positions. When partly or entirely in the horizontal plane, the horizontal support 26 is in the in-use position and can be comfortably used as a desk by a person sitting in a seat or chair behind seat 10, and provides a surface on which to place work materials, note-taking materials, test materials, electronic devices and the like. When partly or entirely in the vertical plane, the horizontal support 26 is in the stowed position and does not obstruct the movement of a person sitting in a seat or chair behind seat 10.

Referring now to FIGS. 5-10 for a description of the seat mounting member 22, a body 28 of the seat mounting member 22 has two different engagement portions 22A, 22B. Engagement portion 22A is used when it is desired to place the horizontal support 26 in the in-use position shown in FIGS. 1 and 3. Engagement portion 22B is used when it is desired to place the horizontal support 26 in the stowed position shown in FIGS. 2 and 4. Thus, to bring the horizontal support 26 from a stowed position into an in-use position, the horizontal support mounting member 24 would be removed from engagement with engagement portion 22B and engaged with engagement portion 22A. The reverse movement would be undertaken to bring the horizontal support 26 from its in-use position into the stowed position. Removing the horizontal support mounting member 24 from engagement with engagement portion 22A requires minimal force greater than that required to lift horizontal support mounting member 24 and horizontal support 26.

Engagement portion 22A includes a slot 30 defined laterally by a rear wall 32 of the body 28, and vertically by two projections 34, 36 that project from the rear wall 32 of the body 28. Projections 34, 36 may be separate from or integrated/integral with the body 28. In the latter case, projections 34, 36 may each be considered as a raised surface of the body 28. Projection 34 is situated below the slot 30 and thereby forms at its upper edge, a support lip 38 for the horizontal support mounting member 24 when present in the slot 30. Projection 36 is situated above the slot 30 and includes two spaced apart flanges 40 that project a greater distance than a central region 42 of the projection 36. Each flange 40 has a downwardly projecting lip 44 at a rear that serves to retain the horizontal support mounting member 24 when present in the slot 30 (see FIG. 6). The lips 44 are thus not continuous along the rear of the projection 36, but rather defined discontinuously by the separated flanges 40. Construction of the flanges 40 separated by the central region 42 provides the lower region of the projection 36 with a form that is substantially complementary to the form of the horizontal support mounting member 24 described below, to provide for a secure retention of the horizontal support mounting member 24 by engagement portion 22A.

To enable the horizontal support mounting member 24 to be securely retained in the slot 30 without falling out, the distance D1 between the projection lip 44 of the projection 36 and the support lip 38 is shorter than the height D2 of the rear part of the horizontal support mounting member 24 that is designed for insertion into the slot 30. Implementation of the dimensioning of the projections 34, 36 and horizontal support mounting member 24 to allow for this secure retention would be readily apparent to one skilled in the art to which this invention pertains in view of the disclosure herein.

Insertion of the horizontal support mounting member 24 into the slot 30 is effected by rotating the assembly of the horizontal support mounting member 24 and horizontal support 26 until the horizontal support 26 is angled slightly higher than horizontally. Then, an upper edge of the horizontal support mounting member 24 is inserted into the slot 30 and the horizontal support mounting member 24 is pivoted against the rear wall 32 of the body 28 until the lower edge of the horizontal support mounting member 24 rests on the support lip 38. In this position, the projecting lips 44 of the flanges 40 catch exposed surfaces of the horizontal support mounting member 24 in order to retain it while the horizontal support 26 is lowered into the horizontal, use position.

In one embodiment, the horizontal support mounting member 24 and the seat mounting member 22 may be designed so that the breaking stress between the horizontal support mounting member 24 and the seat mounting member 22, when in the in-use position, is less than a calculated stress. A person skilled in the relevant art would be capable of so designing the support mounting member 24 and the seat mounting member 22. This calculated stress may be less than the stress required to break the horizontal support 26, break the horizontal support 26 from the horizontal support mounting member 24, break the seat mounting member 22 from the seat 10, break the back portion 18 of the seat 10, and/or break the back portion 18 of the seat 10 from the seat 10. In a preferred embodiment, said breaking stress is less than 200 pounds of force perpendicular to the plane of the horizontal support 26. This may prevent damage to the seat 10 and/or other components, should a person attempt to cause damage or accidentally overburden the horizontal support 26.

In another embodiment, the horizontal support 26 and the horizontal support mounting member 24 may be designed so that the breaking stress between the horizontal support 26 and the horizontal support mounting member 24 is less than a calculated stress. A person skilled in the relevant art would be capable of so designing the horizontal support 26 and the horizontal support mounting member 24. This calculated stress may be less than the stress required to break the seat mounting member 22 from the seat 10, break the back portion 18 of the seat 10, and/or break the back portion 18 of the seat 10 from the seat 10. In a preferred embodiment, said breaking stress is less than 200 pounds of force perpendicular to the plane of the horizontal support 26. This may prevent damage to the seat 10 and/or other components, should a person attempt to cause damage or accidentally overburden the horizontal support 26.

Removal of the horizontal support mounting member 24 from the slot 30 is effected by lifting the horizontal support mounting member 24 upward away from the support lip 38 (while still being situated in the slot 30) and then pivoting it about an upper region and outward away from the rear wall 32 of the body 28 until the lower edge of the horizontal support mounting member 24 can be swung clear of the support lip 38. The depth of a channel 46 formed by the projection lips 44 (shown in FIG. 6) is dimensioned to allow for this insertion and removal, and could be easily ascertained by those skilled in the art based on the dimensions of the horizontal support mounting member 24 in view of the disclosure herein. This dimensioning is such that the force required to lift, pivot and swing clear the horizontal support mounting member 24 is minimized. Keeping the force required to remove the horizontal support member 24 from the slot 30 at a minimum allows the desk to be moved out of the use position as easily and as quickly as possible. Ease and speed of moving the desk out of the use position improves both user convenience whenever the desk is used and user safety in the case of evacuation or other emergency. This improvement in safety may be required to comply with pertinent fire and/or other safety codes.

Figure 7:
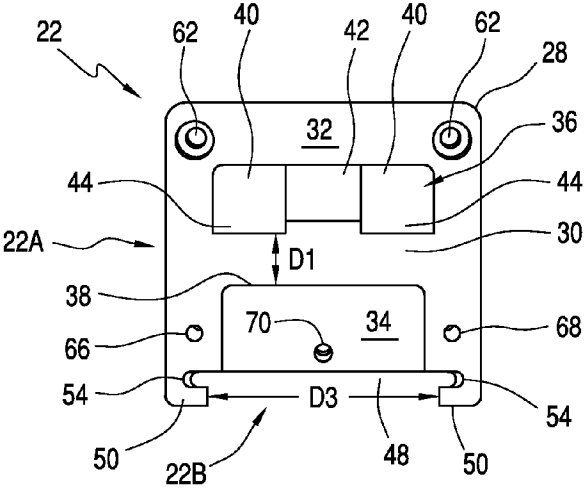
FIG. 7 is a rear view of the seat mounting member shown in FIG. 5.

As best seen in FIG. 7, engagement portion 22B includes an elongated cutout or slot 48 opening to a bottom of the seat mounting member 22, and which slot 48 receives part of the horizontal support mounting member 24. To form the slot 48, the seat mounting member 22 includes two inward projections 50, which also serve to operatively support the horizontal support mounting member 24 when in the stowed position. A distance D3 between the inward projections 50 is less than a length D4 of a base 52 of the horizontal support mounting member 24 to prevent the horizontal support mounting member 24 from falling out of the slot 48. Lateral edges 54 of the slot 48 are angled inwardly such that the width of the slot 48 at the front of the body 28 is less than the width of the slot 48 at the rear of the body 28. This angling is complementary to the angling of lateral edges 56 of the base 52 of the horizontal support mounting member 24, best seen in FIG. 13 and described below.

The slot 48 may be angled upward such that when the horizontal support mounting member 24 is inserted therein, the distal edge of the horizontal support 26 (the far edge) extends toward the seat 10. By having the horizontal support 26 close to the seat 10, breakage occurring due to a person kicking the stowed horizontal support 26 from the seat behind seat 10 may be reduced and hopefully prevented. Further, by having the horizontal support 26 close to the seat 10, minimal space behind seat 10 is taken up by the desk in the stowed position. Because the desk takes up minimal space in the stowed position, it does not block ingress or egress of users from the space behind the seat 10, including the ingress or egress of the user of the invention. This improves ease of use and safety of users. This improvement in safety may be required to comply with pertinent fire and/or other safety codes.

Figure 8:
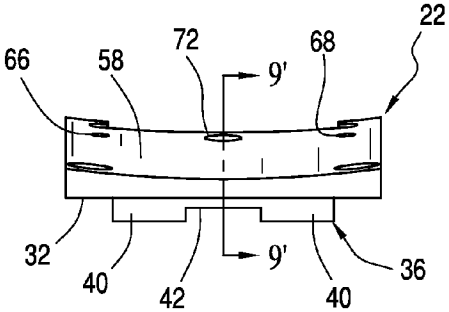
FIG. 8 is a top view of the seat mounting member shown in FIG. 5.

The body 28 of the seat mounting member 22 may have a curved front surface 58 (see FIG. 8). Curvature of the front surface 58 is designed to allow the seat mounting member 22 to extend closely across, and ideally conform to the shape of, the rear surface 60 of the back portion 18 of the seat 10, which is typically curved (see FIGS. 1 and 2). The front surface 58 may also be flat to allow the seat mounting member 22 to extend closely across, and ideally conform to the shape of, the rear surface 60 of the back portion 18 of the seat 10 if such rear surface 60 is flat. Each upper corner of the body 28 includes a respective channel 62 through which a bolt or other attachment device (64 as shown in FIGS. 26 and 27) is passed in order to attach the body 28 of the seat mounting member 22 to the back portion 18 of the seat 10.

The desk 20 therefore includes connecting means for connecting the seat mounting member 22 to the back portion 18 of the seat 10. These connecting means are not limited to the presence of the two channels 62 in the body 28 and the bolts 64 that pass through these channels 62 and into the back portion 18 of the seat 10. Rather, any other structure that is capable of connecting the body 28 of the seat mounting member 22 to the back portion 18 of the seat 10 is contemplated as being within the scope of the connecting means in accordance with the invention. Such connecting means may be glue, adhesive, tape, screws, rivets, nut-and-bolt assemblies and a tongue and groove type fastener.

The bottom of the body 28 of the seat mounting member 22 includes three channels, one channel 66 on the left side of the projection 34, one opening 68 on the right side of the projection 34, and one channel 70 in the center through the projection 34 (see FIG. 7). Channels 66 and 68 may align with one another while channel 70 may be below the line connecting channels 66, 68, as shown. Channels 66, 68, 70 are generally smaller than channels 62.

Figure 26:
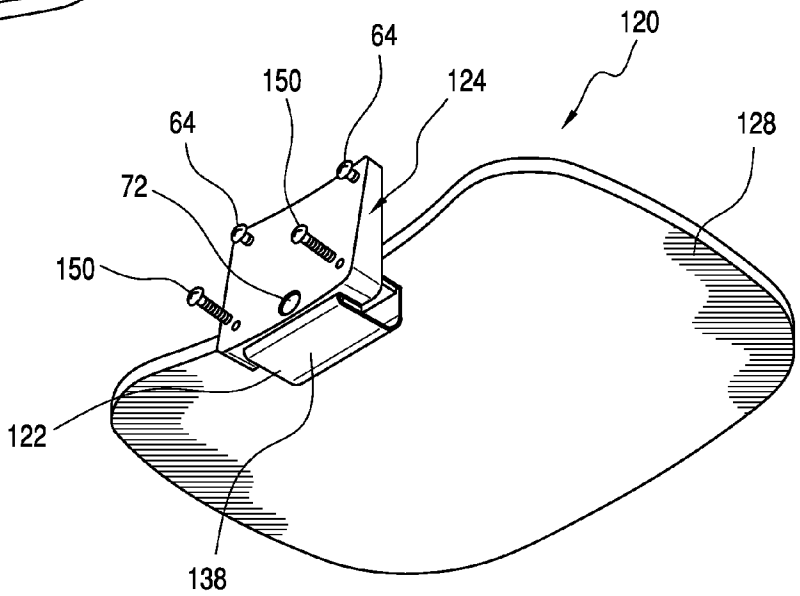
FIG. 26 is a front, bottom perspective view of the desk shown in FIG. 16 showing connectors that connect the horizontal support mounting member to a seat.
Figure 27:
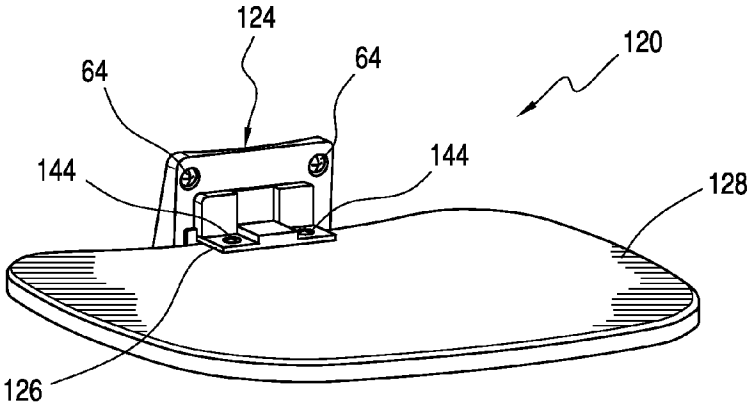
FIG. 27 is a rear, top perspective view of the desk shown in FIG. 16 showing connectors that connect the horizontal support mounting member to a seat.

Channels 66, 68, 70 function in a similar manner as channels 62 in that they enable a respective bolt to pass through to attach the body 28 of the seat mounting member 22 to the back portion 18 of the seat 10 (such bolts designated 150 are shown for the second embodiment in FIG. 26). Thus, the desk 20 further includes additional connecting means for connecting the seat mounting member 22 to the back of the seat 10, separate and apart from those at the upper corners of the body 28. These additional connecting means may have the same structure as any of the connecting means identified above for use at the upper corners of the body 28.

Figure 9:
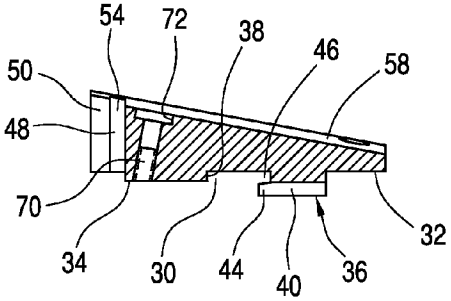
FIG. 9 is a cross-sectional view of the seat mounting member shown in FIG. 5 taken along the line 9' in FIG. 8.
Figure 14:
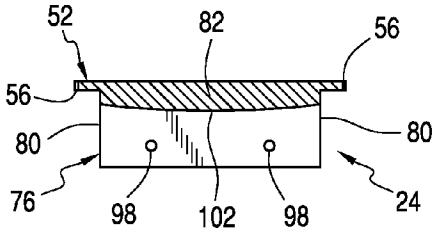
FIG. 14 is a cross-sectional view of the horizontal support mounting member shown in FIG. 10 taken along the line 14' in FIG. 11.
Figure 21:
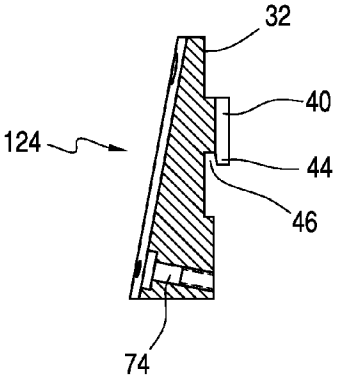
FIG. 21 is a cross-sectional view of the seat mounting member shown in FIG. 16 taken along the line 21' in FIG. 18.
Figure 25:
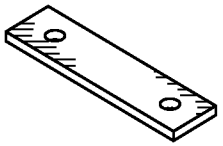
FIG. 25 is a perspective view of a support for the connector shown in FIG. 24.

However, as shown in FIG. 9, the channel 70 may include a larger diameter opening 72 adjacent the front surface 58 and house an internally threaded rivet component (74 shown in FIG. 21) that includes a head and a cylindrical internally threaded portion extending therefrom. The cylindrical internally threaded portion may be configured to receive a threaded bolt that is inserted through channel 70. By rotating the threaded bolt in channel 70 that engages with the rivet component, the distance and angle between the bottom of the seat mounting member 22 and the back portion 18 of the seat 10 is adjusted. This may allow for body 28 to move with respect to the seat 10, in order to ensure that the horizontal support member 26 may extend substantially horizontally even when the angle of the rear surface of the back portion 18 of the seat 10 is not vertical, e.g., depending on the auditorium configuration of seats.

The desk 20 therefore includes angular adjustment means for adjusting an angle between a rear surface of the back portion 18 of the seat 10 to which the desk 20 is attached and the desk 20 in order to change the plane of the horizontal support member 26 (and preferably to make this plane level with a horizontal plane and thereby reduce the possibility of materials on the upper surface of the horizontal support member 26 falling off). These angular adjustment means are not limited to the presence of the channel 70, a threaded bolt therein, opening 72 and the rivet component 74 therein. Rather, any other structure that is capable of changing an angle between the front surface 58 of the body 28 and the rear surface 60 of the back portion 18 of the seat 10 is contemplated as being within the scope of the angular adjustment means in accordance with the invention. Alternative angular adjustment means are readily identifiable by and/or known to those skilled in the art to which this invention pertains in view of the disclosure herein.

Body 28 may be dimensioned so that it does not extend across the entire rear surface 60 of the back portion 18 of the seat 10. Rather, it may have a length of about 4-5 inches. Ideally, the body 28 would be centered on the rear surface 60 of the back portion 18 of the seat 10. If a centered positioning is sought, then the rear surface 58 of the body 28 would be substantially symmetrical about the central vertical plane. The body 28 need not be centered on the rear surface 60 of the back portion 18 of the seat 10. For example, if seat 10 and the seat anticipated to be used by user are not aligned, body 28 may be placed off-center on the rear surface 60 of the back portion 18 of the seat 10 so as to be positioned correctly for use by a user sitting in a seat located in the row behind seat 10.

An advantage of the seat mounting member 22 is that it does not require hooks to hang over the seat 10 and thereby possibly interfere with the comfort of the person sitting in seat 10. Rather, the seat mounting member 22 is easily attached only to the back portion 18 of the seat 10 using, for example, screws, and moreover, only over a small portion of the rear surface of the back portion 18 of the seat 10. This is distinct from other desks and trays retrofittable to chairs in that other such desks and trays require hooks and/or attachment to structures, such as headrests, that may not be present in all seats and chairs.

The horizontal support mounting member 24 is shown in FIGS. 10-14 and includes the base 52 and a U-shaped portion 76 extending from a broader side 78 of the base 52. The base 52 and U-shaped portion 76 may be formed separate from one another and connected together, or more likely, formed as an integral, one-piece body.

Base 52 includes angled, lateral edges 56 that serve to aid in guiding the base 52 into the slot 48 of the engagement portion 22B when moving the horizontal support 22 into its stowed position. Lateral edges 56 have a similar angling as the angled lateral edges 54 of the slot 48. The thickness of the base 52 is slightly smaller than the thickness of the slot 48 to allow for insertion of the base 52 into the slot 48 (see FIGS. 2 and 4). Lateral edges 80 of the U-shaped portion 76 are distanced from the lateral edges 80 of the base 52 to prevent the U-shaped portion 76 from interfering with the movement of the base 52 into the slot 48.

Figure 11:
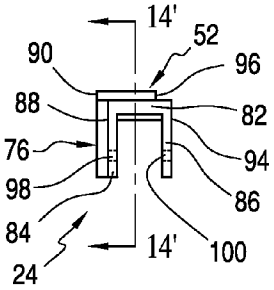
FIG. 11 is a right side view of the horizontal support mounting member shown in FIG. 10 rotated 90°.
Figure 10:
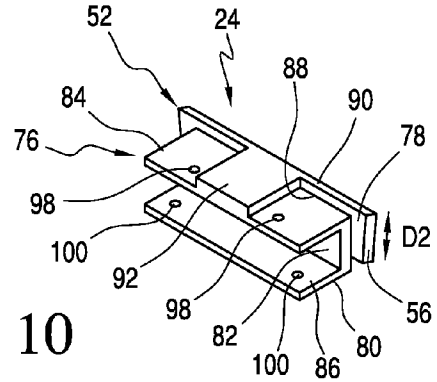
FIG. 10 is a rear, right perspective view of a horizontal support mounting member of the desk in accordance with the invention shown in FIGS. 3 and 4.
Figure 13:
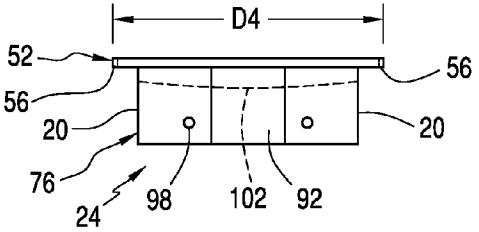
FIG. 13 is a top view of the horizontal support mounting member shown in FIG. 10.

U-shaped portion 76 includes a bottom portion 82 and two leg portions 84, 86 that are spaced apart from one another in order to retain part of the horizontal support 26 therebetween, and are also substantially parallel to one another (see FIG. 11). Another way to consider the base 52, is by viewing its profile shown in FIG. 11, as a jaw with two jaw portions (84, 86) that define a mouth into which the horizontal support 26 is inserted.

Bottom portion 82 adjoins the base 52 and its rear surface 102 has a shape that preferably complements the shape of the part of the horizontal support 26 that is inserted between the leg portions 84, 86. As shown in FIG. 15, the horizontal support 26 may be curved all around and thus the surface 102 may be curved (see FIG. 14).

Figure 12:
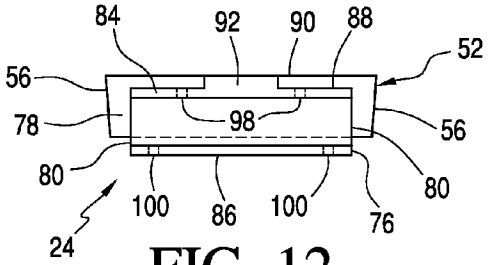
FIG. 12 is a rear view of the horizontal support mounting member shown in FIG. 10.

An upper longitudinal edge 88 of the bottom portion 82 and adjacent leg portion 84 does not align completely with an upper longitudinal edge 90 of the base 52, but rather is partly inwardly displaced therefrom on both sides of a central raised region 92 (see FIG. 12). Construction of the central raised region 92 between inwardly displaced portions of the bottom portion 82 and leg portion 84 at the upper surface of the horizontal support mounting member 24 provides the horizontal support mounting member 24 with a similar profile as the lower region of the projection 34 to thereby enable a secure fitting of the horizontal support mounting member 24 to the engagement portion 22A of the seat mounting member 22.

A lower longitudinal edge 94 of the bottom portion 82 and adjacent leg portion 88 is outwardly displaced from the lower longitudinal edge 96 of the base 52 (see FIG. 11). This outward displacement results in the lower longitudinal edge 96 of the base 52 being exposed and thus capable of resting on the support lip 38 defined by the projection 34.

The upper leg portion 84 includes two openings 98 closer to the central raised region 92 than two openings 100 in the lower leg portion 86. The four openings 98, 100 may accept four rivets, screws, or other attachment mechanisms for permanently attaching the horizontal support 26 to the horizontal support mounting member 24.

The desk 20 therefore includes connecting means for connecting the horizontal support mounting member 24 to the horizontal support 26. These connecting means are not limited to the presence of the four openings 98, 100 in the leg portions 84, 86 of the U-shaped portion 76 of the horizontal support mounting member 24 and the rivets or screws that pass through these openings 98, 100 and into the horizontal support 26. Rather, any other structure that is capable of connecting the horizontal support mounting member 24 to the horizontal support 26 is contemplated as being within the scope of the connecting means in accordance with the invention. Such connecting means may be glue, adhesive, tape, rivets, a nut and bolt assembly, nails, screws, and a tongue and groove type fastener.

Referring now to FIG. 15, the horizontal support 26 is preferably provided with a unique shape in consideration of ergonomics. As shown, the horizontal support 26 is curved all around its periphery. However, the invention contemplates different shaped horizontal supports limited only by the required presence of a part that can be inserted between the leg portions 84, 86 of the horizontal support mounting member 24 and then fixed thereto via the connecting means described immediately above. It should be understood that any surface shape may be attachable to the horizontal support mounting member 24.

The composition and finish of the horizontal support 26 would be readily known or ascertainable to those skilled in the art to which this invention pertains in view of the disclosure herein. Criteria relevant to the selection of the composition and material include, but are not limited to, the desire to have a smooth surface for note-taking, test-taking, etc., the desire to have a sturdy, long-lasting desk surface, and the desire to provide sufficient strength to avoid easy breakage. Moreover, the horizontal support 26 may vary from the illustrated embodiment wherein it has an entirely planar upper surface, e.g., it may have an upper surface that is partly or mostly planar. It may include apertures for placement of items, as known to those skilled in this art.

Referring now to FIGS. 16-27, in another embodiment of a desk in accordance with the invention, designated 120, a different engagement is used to provide the horizontal support 26 with its stowed position, instead of engagement portion 22B as described above. This engagement includes a flexible connector 122 that connects a seat mounting member 124 to a horizontal support mounting member 126 that in turn is connected to a horizontal support 128. Generally, the flexible connector 122 represents a high strength tether that is located between the horizontal support mounting member 126 and the seat mounting member 124, or more broadly stated, interposed between the seat mounting member 124 and the horizontal support 128, that serves to prevent the horizontal support 128 and the horizontal support mounting member 126 from being removed from connection to the seat mounting member 124, stolen, or the like.

Seat mounting member 124 is fixed to the back portion 18 of the seat 10 in any of the ways described above for fixing seat mounting member 22 to the back portion 18 of the seat 10. Differing from seat mounting member 22, seat mounting member 124 does not include engagement portion 22B, i.e., it does not include the slot 48 and attendant structure. Rather, seat mounting member 124 includes a pair of channels 130 opening to its bottom face 132 into which bolts, screws and the like are inserted (see FIG. 19). Otherwise, seat mounting member 124 includes similar structure as seat mounting member 22, including, without restriction, engagement portion 22A defined by projections 34, 36 and channels 62, connecting means such as channels 62, 66, 68, 70 and other structures other than engagement portion 22B.

Figure 24:
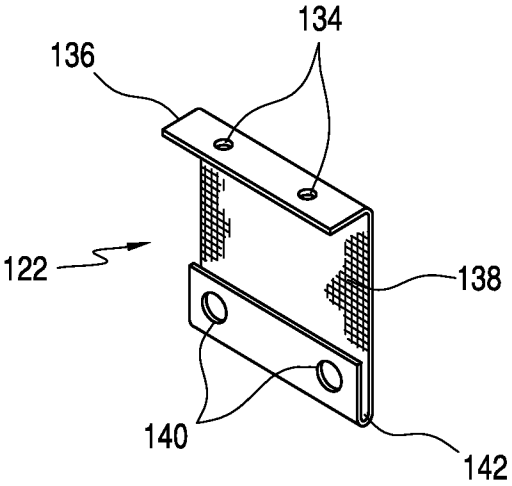
FIG. 24 is a perspective view of a flexible connector that connects the seat mounting member shown in FIG. 16 to a horizontal support mounting member of the desk in accordance with the invention shown in FIG. 22.
Figure 23:
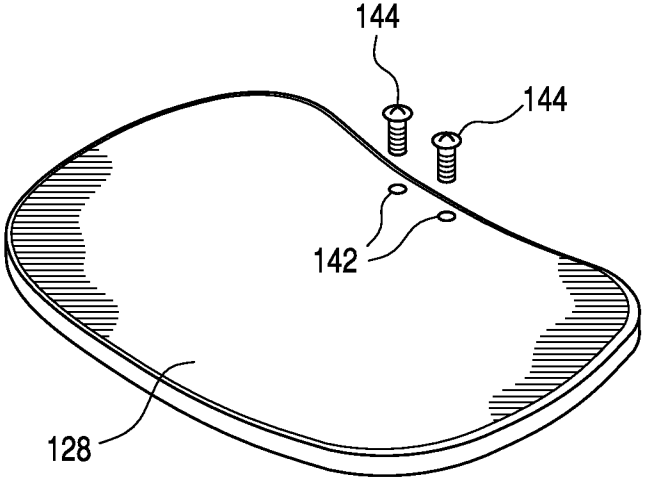
FIG. 23 is a perspective view of a horizontal support member of the desk in accordance with the invention shown in FIG. 16.

Flexible connector 122 is shown in FIG. 24 and includes a pair of apertures 134 on a flange 136 that have the same spaced relationship as channels 130. This enables a bolt or screw to pass through an aperture 134 and then into a respective channel 130 in order to fix the flexible connector 122 to the bottom face 132 of the seat mounting member 124.

The desk 120 therefore includes connecting means for connecting the flexible connector 122 to the seat mounting member 124. These connecting means are not limited to the means explicitly disclosed herein, namely the presence of the two channels 130 opening at the bottom face 132 of the body 28 of the seat mounting member 122, the apertures 134 in the flange 136 of the flexible connector 122 and the bolts or screws that pass through these apertures 134 and channels 130. Rather, any other structure that is capable of connecting the flange 136 of the flexible connector 122 to the body 28 of the seat mounting member 124 is contemplated as being within the scope of the connecting means in accordance with the invention. Such connecting means may be glue, adhesive, tape, rivets, a nut and bolt assembly, nails, screws, and a tongue and groove type fastener.

In addition to flange 136, the flexible connector 122 includes a webbing 138 having a U-shaped fold 142. The flange 136 is situated at one end of the webbing 138 and the U-shaped fold 142 at the other end, and two apertures 140 are formed spaced apart from one another in the U-shaped fold 142.

Figure 22:
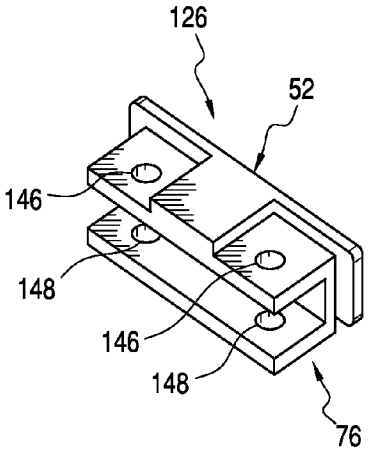
FIG. 22 is a rear, right perspective view of a horizontal support mounting member of the desk in accordance with the invention shown in FIG. 16.
Figure 20:
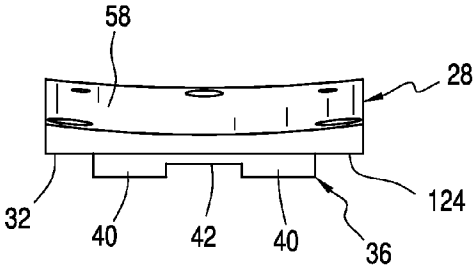
FIG. 20 is a top view of the seat mounting member shown in FIG. 16.
Figure 18:
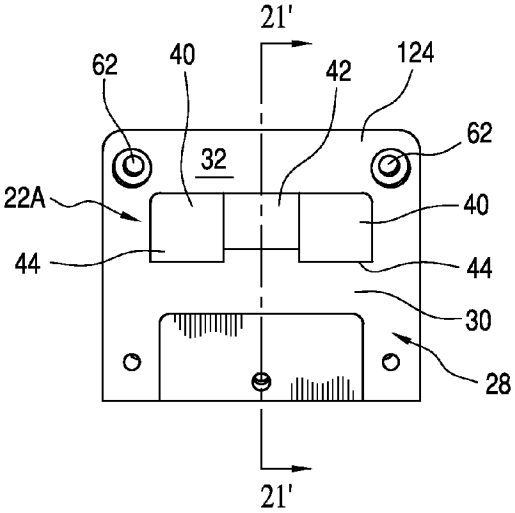
FIG. 18 is a rear view of the seat mounting member shown in FIG. 16.
Figure 19:
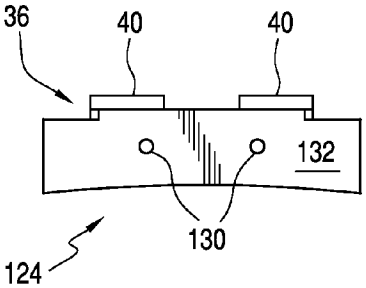
FIG. 19 is a bottom view of the seat mounting member shown in FIG. 16.

The horizontal support mounting member 126 is shown in FIG. 22. The main difference between horizontal support mounting member 126 and horizontal support mounting member 24 is that the openings 146, 148 on the leg portions 84, 86 are larger than openings 98, 100 and aligned with one another. The spacing between openings 146, 148 on each leg portion 84, 86 of horizontal support mounting member 126 is also the same as the spacing between apertures 140 on the flexible connector 122. The horizontal support 128 is also provided with channels 142 of the same spacing (see FIG. 23). As such, connectors 144 may be passed through apertures 140, openings 146, 148 and channels 142 and thereby secure the horizontal support mounting member 126 to the horizontal support 128. A bolt is provided on the other side of the connectors 144, e.g., when they are nuts.

The desk 120 therefore includes connecting means for connecting the horizontal support mounting member 126 to the horizontal support 128. These connecting means are not limited to the presence of the aligning openings 146, 148 in the leg portions 84, 86 of the U-shaped portion 76 of the horizontal support mounting member 126, the channels 142 in the horizontal support 128, the openings 140 in the flexible connector 122 and the rivets, bolts or screws 144 passing therethrough. Rather, any other structure that is capable of connecting the horizontal support mounting member 126 to the horizontal support 128 is contemplated as being within the scope of these connecting means in accordance with the invention. Such connecting means may be glue, adhesive, tape, rivets, a nut and bolt assembly, nails, screws, and a tongue and groove type fastener.

In most respects then, the horizontal support mounting member 126 includes or has the same features as horizontal support mounting member 24 and horizontal support 128 includes or has the same features as horizontal support 26.

As with the first embodiment described with respect to FIGS. 1-15, for the embodiment described with respect to FIGS. 16-27, the horizontal support mounting member 126 is positionable relative to the seat mounting member 124 in two different ways, either to provide the horizontal support 128 with a use position in which it lies preferably in a horizontal plane and or with a stowed position in which it lies generally in a vertical plane. Changing between the two different positions of the horizontal support mounting member 126 to the seat mounting member 124 is designed to be very convenient to allow for quick switching between the use position and the stowed position.

Specifically, in the use position shown in FIGS. 26 and 27, the horizontal support mounting member 126 attaches to the seat mounting member 124 in substantially the same way as the horizontal support mounting member 24 attaches to the seat mounting member 22 (via engagement portion 22A defined by body 28). The webbing 138 of the flexible connector 122 easily bends to allow for this position (see FIG. 26).

However, in the stowed position, the horizontal support mounting member 126 attaches to the seat mounting member 124 in a different way from the horizontal support mounting member 24 attaches to the seat mounting member 22 because the seat mounting member 124 lacks a slot 48.

Figure 16:
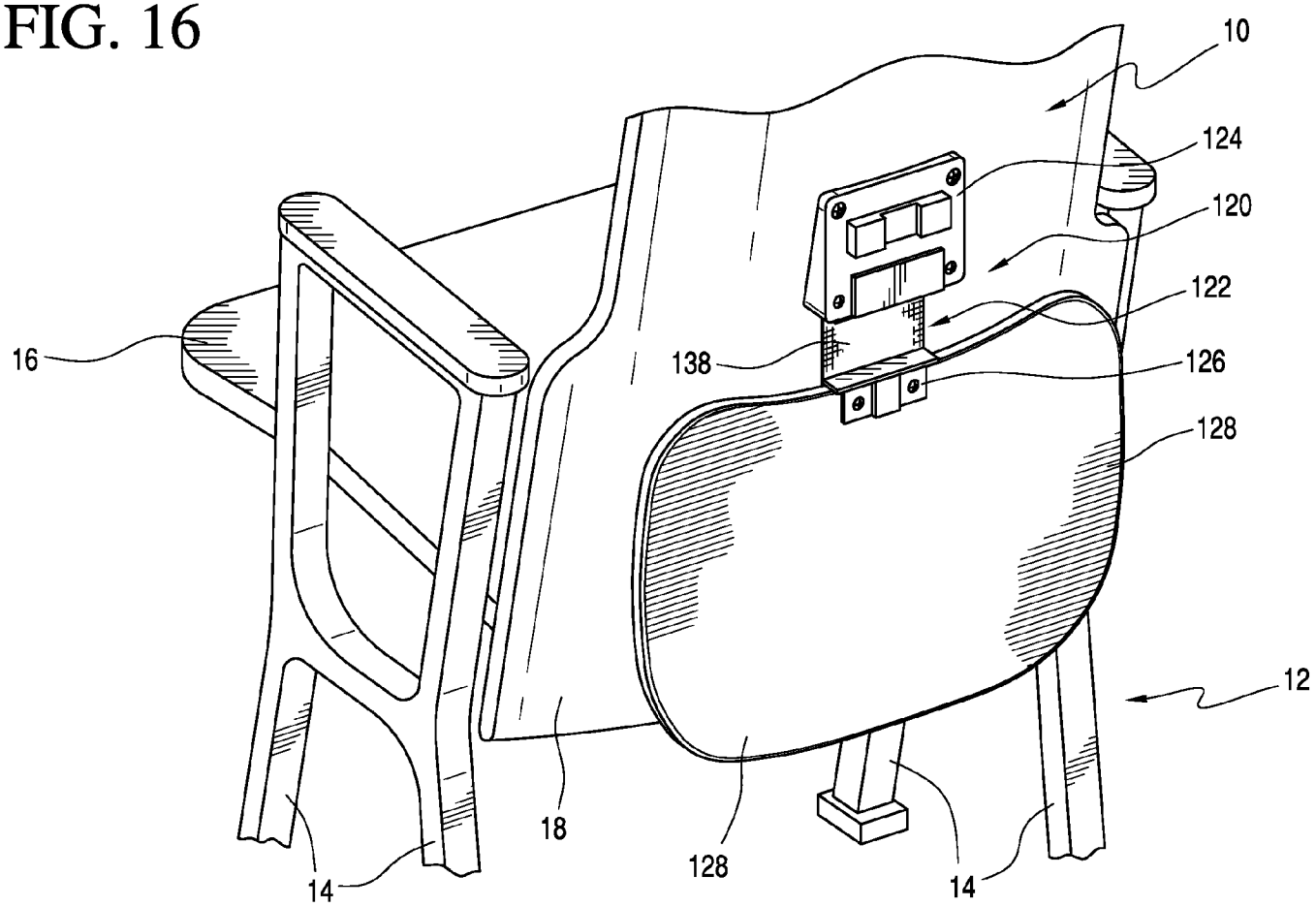
FIG. 16 is a rear, right perspective view of a seat showing a second embodiment of an desk in accordance with the invention attached thereto with its horizontal support member in a stowed position hanging from webbing.
Figure 17:
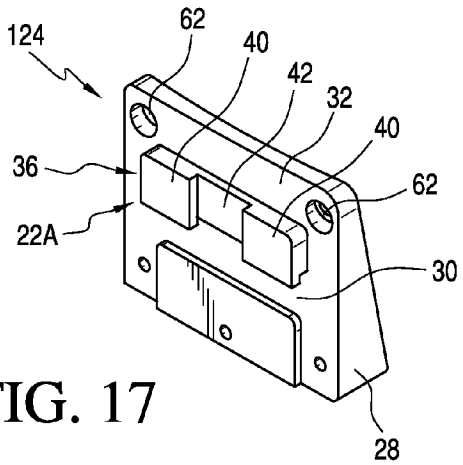
FIG. 17 is a rear, right perspective view of a seat mounting member of the desk in accordance with the embodiment shown in FIG. 16.

Flexible connector 122 serves as the attachment structure to provide for a connection of the horizontal support 128, and the horizontal support mounting member 126 connected thereto, to the seat mounting member 124 (see FIG. 16). With the flexile connector 122, the horizontal support 128 is maintained in engagement with the seat mounting member 124, hanging down by virtue of the flexible webbing 138 of the connector 122, so that it is readily available to be brought into the use position.

Flexible connector 122 securely attaches the horizontal support 128, and the horizontal support mounting member 126 connected thereto, to the seat mounting member 124. This secure attachment hinders disengagement of the horizontal support 128 from the seat mounting member 124, and thus theft of the horizontal support 128.

A method for equipping an auditorium with desks using any of the embodiments of the desk disclosed above is also part of the invention. In such an auditorium, there are rows of seats one behind another. Use of the auditorium could be greatly expanded if desks could be formed. In this case, the auditorium could be used for test-taking.

To this end, the method would entail attaching a respective desk to the back portion of seats in one or more rows of the seats in the auditorium. The precise vertical height at which to mount the body 28 of the seat mounting member 22 or 124 to the back portion 18 of the seat 10 to provide a useable desk would be readily ascertainable by those skilled in the art to which this invention pertains in view of the disclosure herein.

While the foregoing description and drawings represent the preferred embodiments of the present invention, it will be understood that various changes and modifications may be made without departing from the scope of the present invention.

The invention claimed is:

1. A desk, comprising:

a seat mounting member configured to attach to a vertical surface and including a body defining first and second engagement portions;

a horizontal support member defining an at least partly planar upper surface; and a horizontal support mounting unit for connecting said horizontal support member to said seat mounting member in a first position in which the horizontal support mounting unit is engaged with said first engagement portion of said seat mounting member and said upper surface of said horizontal support member is substantially in an in-use position, and connecting said horizontal support member to said seat mounting member in a second position in which the horizontal support mounting unit is engaged with said second engagement portion of said seat mounting member and said upper surface of said horizontal support member is substantially in a stowed position; and said first engagement portion including a slot defined laterally by a rear wall of said body and vertically by upper and lower projections projecting rearwardly from said rear wall, said lower projection including a support lip at its upper edge configured to support said horizontal support mounting unit when in said first position, said upper projection including at least one flange including a rear edge and a downwardly projecting lip at said rear edge that retains said horizontal support mounting unit when in said first position.

2. The desk of claim 1, wherein said seat mounting member further includes connecting means for connecting said body to said vertical surface.

3. The desk of claim 2, wherein said body of said seat mounting member has a curved front surface, further comprising angular adjustment means for adjusting a distance between said front surface of said body of said seat mounting member and the vertical surface to which said seat mounting member is attached.

4. The desk of claim 3, wherein said angular adjustment means is a threaded bolt disposed in a channel in said body of said seat mounting member.

5. The desk of claim 1, wherein said horizontal support mounting unit is configured to be separable by a user from said seat mounting member to enable movement between said first and second positions.

6. The desk of claim 1, wherein said horizontal support mounting unit is configured to release from said first engagement portion when in said first position and an amount of force in a direction perpendicular to said upper surface of said horizontal support member is exerted greater than a specified tolerance.

7. The desk of claim 6, wherein said specified tolerance is approximately 200 pounds.

8. The desk of claim 1, wherein said horizontal support member is configured to detach from said horizontal support mounting unit when an amount of force in a direction perpendicular to said upper surface of said horizontal support member is exerted greater than a specified tolerance.

9. The desk of claim 8, wherein said specified tolerance is approximately 200 pounds.

10. The desk of claim 1, wherein said at least one flange has a complementary construction to an upper region of said horizontal support mounting unit to enable said at least one flange to hold said upper region of said horizontal support mounting unit in said slot when in said first position.

11. The desk of claim 1, wherein said at least one flange consists of two flanges spaced apart from one another.

12. The desk of claim 1, wherein said second engagement portion includes a slot opening to a bottom and defined in part by two inward projections, said slot being configured to receive part of said horizontal support mounting unit.

13. The desk of claim 12, wherein said horizontal support mounting unit comprises a base and a U-shaped portion extending from said base, a part of said horizontal support member being situated between legs of said U-shaped portion and secured thereto, said base being configured to be received in said slot.

14. The desk of claim 1, wherein said horizontal support mounting unit comprises a base and a U-shaped portion extending from said base, a part of said horizontal support member being situated between legs of said U-shaped portion and secured thereto.

15. The desk of claim 14, wherein said base is connected to said horizontal support member and includes a flexible connector that connects said base to said seat mounting member.

16. The desk of claim 15, wherein said flexible connector includes a webbing to allow said horizontal support member to hang from said seat mounting member to provide said horizontal support member with its second position.

17. The desk of claim 1, wherein said horizontal support mounting unit comprises:

a horizontal support mounting member having a base and a U-shaped portion extending from said base, a part of said horizontal support member being situated between legs of said U-shaped portion and secured thereto; and a flexible connector that connects said base to said seat mounting member.

18. The desk of claim 17, further comprising connecting means for connecting said flexible connector to said seat mounting member.

19. The desk of claim 17, further comprising connecting means for connecting said flexible connector to said horizontal support mounting member and said horizontal support member.

20. The desk of claim 1, wherein said horizontal support mounting unit is configured to maintain a connection between said seat mounting member and said horizontal support member during changing of position of said horizontal support member between the first and second positions.

21. The desk of claim 1, wherein said upper surface of said horizontal support member, when in the second position, does not obstruct passage of a person passing behind a vertical surface to which said seat mounting member is attached.

22. The desk of claim 1, wherein the horizontal support mounting unit is configured so that the force required to move said horizontal support member out of the first position is approximately the total weight of said horizontal support member and said horizontal support mounting unit.

23. A method for equipping an auditorium with desks, the auditorium including rows of seats one behind another, comprising:

attaching the desk of claim 1 to a back portion of at least one seat.

24. The method of claim 23, wherein the step of attaching the desk of claim 1 to a back portion of at least one seat comprises attaching each of a plurality of the desks of claim 1 to a back portion of a respective one of a plurality of seats in a common row in an alternating manner.

25. A desk, comprising:

a seat mounting member configured to attach to a vertical surface;

a horizontal support member defining an at least partly planar upper surface; and a horizontal support mounting unit for connecting said horizontal support member to said seat mounting member in a first position in which said upper surface of said horizontal support member is substantially in an in-use position, and connecting said horizontal support member to said seat mounting member in a second position in which said upper surface of said horizontal support member is substantially in a stowed position said seat mounting member including a body and a slot defined laterally by a rear wall of said body and vertically by upper and lower projections projecting rearwardly from said rear wall, said lower projection including a support lip at its upper edge configured to support said horizontal support mounting unit when in a first position, said upper projection including at least one flange each including a downwardly projecting lip at a rear that retains said horizontal support mounting unit when in the first position.

26. A desk, comprising:

a seat mounting member configured to attach to a vertical surface;

a horizontal support member defining an at least partly planar upper surface; and a horizontal support mounting unit for connecting said horizontal support member to said seat mounting member in a first position in which said upper surface of said horizontal support member is substantially in an in-use position, and connecting said horizontal support member to said seat mounting member in a second position in which said upper surface of said horizontal support member is substantially in a stowed position, said seat mounting member including a body defining first and second engagement portions, said horizontal support mounting unit engaging with said first engagement portion of said seat mounting member when in said first position and engaging with said second engagement portion of said seat mounting member when in said second position, said second engagement portion including a slot opening to a bottom and defined in part by two inward projections, said slot being configured to receive part of said horizontal support mounting unit.

* * * * *